US005207799A

United States Patent [19]

Back et al.

[11] Patent Number: 5,207,799

[45] Date of Patent: May 4, 1993

[54] PROCESS FOR DYEING WOOL AND BLENDS THEREOF WITH OTHER FIBRES USING REACTIVE DYES AND COLORLESS FIBER-REACTIVE DYEING ASSISTANT

[75] Inventors: Gerhard Back; Klaus Hannemann, both of Lörrach, Fed. Rep. of Germany; Josef Koller, Reinach, Switzerland

[73] Assignee: Ciba-Geigy Corporation, Ardsley, N.Y.

[21] Appl. No.: 750,364

[22] Filed: Aug. 27, 1991

[30] Foreign Application Priority Data

Aug. 28, 1990 [CH] Switzerland ..... 2787/90

[51] Int. Cl.[5] ..... D06P 1/62; D06P 3/14

[52] U.S. Cl. ..... 8/449; 8/529; 8/533; 8/543; 8/544; 8/586; 8/590; 8/616; 8/917

[58] Field of Search ..... 8/449, 543, 533

[56] References Cited

U.S. PATENT DOCUMENTS

| | | | |
|---|---|---|---|
| 2,895,785 | 7/1959 | Alsberg et al. | 8/449 |
| 3,700,402 | 10/1972 | Noda et al. | 8/449 |
| 3,775,045 | 11/1973 | Buckler et al. | 8/15 |
| 4,218,217 | 8/1980 | Redd | 8/478 |
| 4,444,564 | 4/1984 | Salathé et al. | 8/588 |
| 4,680,033 | 7/1987 | Durl et al. | 8/449 |

*Primary Examiner*—A. Lionel Clingman
*Attorney, Agent, or Firm*—Marla J. Mathias; Edward McC. Roberts

[57] ABSTRACT

A process is described for fibre- and surface-level dyeing of wool and blends thereof with other fibers using a compound of formula (1)

$$A\text{-}(B\text{—}A)_n, \quad (1)$$

in which n is 0 or 1, and if n is 1, A is a radical of the formula (2)

and B is an alkylene or alkenylene group or a direct bond, or if n is zero, A is a compound of the formula (3)

or (4)

Fibre- and surface-level dyeings, in particular in light to medium color shades are obtained by the dyeing process according to the invention. The dyeing aid according to this invention can be used to substitute formaldehyde containing wool dyeing aids.

14 Claims, No Drawings

PROCESS FOR DYEING WOOL AND BLENDS THEREOF WITH OTHER FIBRES USING REACTIVE DYES AND COLORLESS FIBER-REACTIVE DYEING ASSISTANT

The present invention relates to a process for fibre- and surface-level dyeing of wool and blends thereof with other fibres using reactive dyes, the material dyed by the novel process and an agent for carrying out the process.

It is known from U.S. Pat. No. 4,444,564 to dye fibres of naturally occurring polyamides in a fibre-preserving pH range. However, only dark colour shades can be produced satisfactorily in this process using reactive dyes.

Surprisingly, a novel process has now been found which enables also wool and blends thereof with other fibres to be dyed with reactive dyes in a fibre- and surface-level manner in the fibre-preserving pH range, in particular in light to medium colour shades, by adding colourless, fibre-reactive compounds to the dyebath.

The present invention thus relates to a process for fibre- and surface-level dyeing of wool and blends thereof with other fibres using reactive dyes, which comprises using an aqueous liquor which comprises at least one colourless, fibre-reactive compound of the formula $$A\text{-}(B\text{-}A)_n, \quad (1)$$

in which n is 0 or 1, and if n is 1, A is a radical of the formula

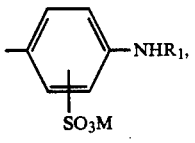

(2)

and B is an alkylene or alkenylene group or a direct bond, or if n is zero, A is a compound of the formula

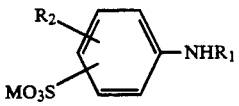

(3)

or of the formula

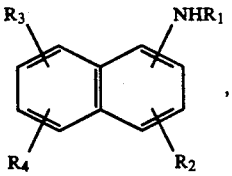

(4)

in which, in the formulae (1) to (4), $R_1$ is a radical of the formula $$-(CO)-\underset{\underset{R}{|}}{(CH)_{n1}}-CH_2-Hal$$

or of the formula

-continued $$-(CO)-\underset{\underset{R}{|}}{C}=CH_2,$$

in which Hal is halogen, R is hydrogen or halogen, $n_1$ is 1 or 0, $R_2$ is hydrogen, $SO_3M$ or $-NH_2$, $R_3$ is hydrogen, $SO_3M$ or a radical of the formula —OX, in which X is hydrogen or $C_1$ to $C_4$alkyl, $R_4$ is hydrogen, $SO_3M$ or a radical of the formula

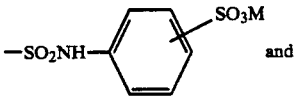

and (5)

M is hydrogen, an alkali metal or ammonium, and the compound of the formula (4) contains at least one $-SO_3M$ group, for dyeing these materials and finishing the dyeing at a pH of 4.0 to 5.0, regardless of the depth of shade.

The alkylene radical in formula (1) is a divalent saturated hydrocarbon radical which contains 2 or 3 carbon atoms, such as ethylene, trimethylene or propylene.

The alkenylene radical in formula (1) is a divalent unsaturated hydrocarbon radical which contains 2 or 3 carbon atoms, such as ethenylene or propenylene.

Alkali metals are lithium, potassium, or, preferably, sodium.

Preferred colourless fibre-reactive compounds are those of the formula

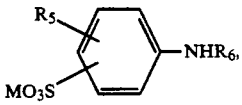

(6)

in which $R_5$ is hydrogen or $SO_3M$, $R_6$ is a radical of the formula $$-(CO)-\underset{\underset{Br}{|}}{CH}-CH_2Br$$

or of the formula $$-(CO)-\underset{\underset{Br}{|}}{C}=CH_2,$$

and M is as defined in formula (3).

Other preferred colourless fibre-reactive compounds are those of the formula

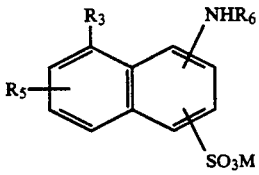

(7)

in which $R_3$, $R_5$, $R_6$ and M are as defined above.

The present process is particularly suitable for the production of light to medium colour shades.

The colourless fibre-reactive compounds of the formula (1) are prepared by methods known per se, by reacting an aromatic amino compound of the formula $Ar—NH_2$, in which Ar is a phenyl or naphthalene radical which is substituted or unsubstituted, with an alkyl or alkenyl halide in an acylation reaction.

The amounts in which the colourless fibre-reactive compounds are used for addition to the dyebath vary between 0.3 and 3, preferably 1 and 2 percent by weight, based on the fibre material to be dyed.

Fibre materials which can be dyed according to the invention are wool or blends of wool with other fibre materials, for example wool/polyacrylic or wool/-polyester blends. Wool is preferably employed for the process according to the invention. The fibre material can be in various make-ups in this process. Possible examples are: flocks, slubbing, yarn, woven fabric, knitted goods or carpets. The wool can be given a normal or antifelting treatment.

Reactive dyes for dyeing the fibre materials by the present process are the organic dyes known by this term—regardless o the nature of their reactive group.

This class of dyes is called "reactive dyes" in the Colour Index, 3rd edition, 1971. They are mainly those dyes which contain at least one group which is reactive with polyhydroxy fibres (cellulose fibres) or polyamide fibres, in particular wool, a precursor for this group or a substituent which is reactive with polyhydroxy fibres or polyamide fibres.

Suitable parent substances of the reactive dyes are, in particular, those from the series comprising mono-, dis- or polyazo dyes, including the formazan dyes, and the anthraquinone, xanthene, nitro, triphenylmethane, naphthoquinonimine, dioxazine and phthalocyanines dyes, it being possible for the azo and phthalocyanine dyes either to be metal-free or to contain metals.

Reactive groups and precursors which form such reactive groups are, for example, epoxy groups, the ethylenimide group, the vinyl grouping in the vinylsulfone or acrylic acid radical and the β-sulfatoethylsulfone group, the β-chloroethylsulfone group or the β-dialkylaminoethylsulfone group.

Reactive substituents which are used in reactive dyes are those which can easily be split off and leave behind an electrophilic radical.

Examples of such substituents are 1 or 2 halogen atoms in an aliphatic acyl radical, for example in the β-position or α- and β-position of a propionyl radical or in the α- and/or β-position of an acrylic acid radical, or 1 to 3 halogen atoms on the following ring systems: pyridazine, pyrimidine, pyridazone, triazine, quinoxaline or phthalazine.

Dyes containing two or more identical or different reactive groups can also be used.

Preferred reactive dyes contain chloroacryloyl, dichloropropionyl, chloroacetyl, bromoacryloyl or dibromopropionyl as reactive substituents.

The reactive dyes can contain acid salt-forming substituents, for example carboxylic acid groups, sulfuric acid and phosphonic acid ester groups, phosphonic acid groups or, preferably, sulfonic acid groups.

Preferred reactive dyes are those having at least one sulfonic acid group, in particular reactive dyes having an azo or anthraquinone parent substance which preferably contains two to three sulfonic acid groups.

Mixtures of reactive dyes can also be used, it being possible to produce bichromatic or trichromatic dyeings.

Dyeing is carried out by the exhaustion process. The amount of dyes added to the dye liquor depends on the desired colour strength. Suitable amounts are in general 0.01 to 10 percent by weight, preferably 0.01 to 2 percent by weight, based on the fibre material employed.

The liquor ratio can be chosen within a wide range, for example 1:3 to 1:100, preferably 1:8 to 1:30.

The dyebaths can contain inorganic acids, for example sulfuric acid or phosphoric acid, organic acids, advantageously aliphatic carboxylic acids, such as formic acid, acetic acid, oxalic acid or citric acid and/or salts, such as ammonium acetate, ammonium sulfate or sodium acetate. The acids are used above all to adjust the pH of the liquors used according to the invention, which is between 4 and 5.

The dye liquors also comprise commercially available levelling agents, which are used to increase the fibre levelness. Alkoxylated fatty amine derivatives are preferably used for the process according to the invention, addition products of 5 to 12 mol of ethylene oxide onto 1 mol of a fatty amine being of chief interest. The dye liquors can also additionally comprise other auxiliaries customary in dyeing technology, for example stabilisers, activators, dispersing agents, electrolytes, wetting agents, defoaming agents, foam suppressants, thickeners or wool protecting agents. Special devices are not necessary for the process according to the invention. The customary dyeing apparatuses, for example open baths, slubbing, hank yarn or pack apparatuses, jigger and paddle apparatuses, beam dyeing apparatuses, circulation or jet dyeing apparatuses or winch becks, can be used.

Dyeing is advantageously carried out at a temperature in the range from 60° to 120° C., preferably 70° to 105° C. The dyeing time is kept within the usual limits and is as a rule 20 to 120 minutes.

When the dyeing has ended, the dying process can be followed by an alkaline after-treatment, for example with aqueous ammonia, alkali metal hydroxides, alkali metal carbonates or bicarbonates or hexamethylenetetramine. The pH of the dyebaths containing alkali is advantageously 7.5 to 9, preferably 8 to 8.5.

The fibre material is advantageously dyed by briefly treating the goods to be dyed with an aqueous liquor which contains the acid, a levelling agent and the colourless, fibre-reactive compound and has a temperature of 30° to 60° C., and adding the reactive dye to the same bath. Thereafter, the temperature is slowly increased, for dyeing to be carried out in a range from 80° to 100° C. for 20 to 90, preferably 30 to 60 minutes. The goods to be dyed are then treated at 70° to 90° C. for a further 10 to 20 minutes, after addition of alkalis, preferably sodium bicarbonate or sodium carbonate, if required. Finally, the dyed material is removed from the bath and rinsed, acidified and dried in the usual manner.

Fibre- and surface-level dyeings, in particular in light to medium colour shades with good light and wet fastness properties, are obtained by the dyeing process according to the invention.

The present invention furthermore relates to the dyeing assistant which comprises a carrier and at least one colourless fibre-reactive compound of the formula $$A\text{-}(B—A)_n, \quad (1)$$

in which n is 0 or 1, and if n is 1, A is a radical of the formula

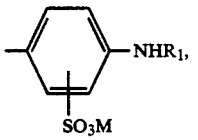

(2)

and B is an alkylene or alkenylene group or a direct bond, or if n is zero, A is a compound of the formula

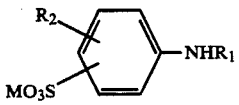

(3)

or of the formula

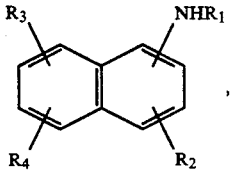

(4)

in which, in the formulae (1) to (4), $R_1$ is a radical of the formula

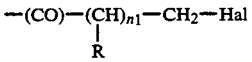

or of the formula

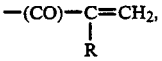

in which Hal is halogen, R is hydrogen or halogen, $n_1$ is 1 or 0, $R_2$ is hydrogen, $SO_3M$ or $—NH_2$, $R_3$ is hydrogen, $SO_3M$ or a radical of the formula 'OX, in which X is hydrogen or $C_1$ to $C_4$alkyl, $R_4$ is hydrogen, $SO_3M$ or a radical of the formula

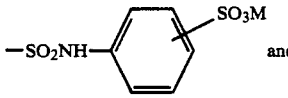

(5) and

M is hydrogen, an alkali metal or ammonium, and the compound of the formula (4) contains at least one $—SO_3M$ group.

Preferred dyeing assistants comprise at least one compound of the formula

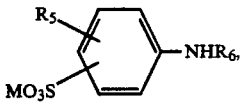

(6)

in which $R_5$ is hydrogen or $SO_3M$, $R_6$ is a radical of the formula

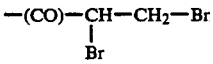

or of the formula

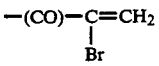

and M is as defined in formula (3).

Other preferred dyeing assistants comprises at least one compound of the formula

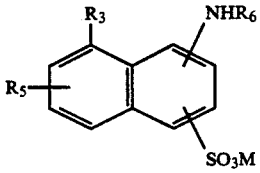

(7)

in which $R_3$, $R_5$, $R_6$, M and X are as defined in the formulae (4) and (6).

The assistants according to the invention are also preferably used as wool protecting agents in dyeings of wool and blends thereof with other fibres, in particular fibre blends of wool and polyester, in the high temperature range. They improve the mechanical properties of the fibres here, and reduce the yellowing of the wool. The assistants according to the invention are thus a completely equivalent substitute for conventional formaldehyde-containing wool protecting agents. The amounts used for this application are between 1 and 6%, based on the fibre material to be treated, it being possible for the compounds to be used in combination with all acid dyes with and without reactive groups.

The assistants according to the invention are furthermore used for soil-repellent treatment of wool fibre material.

Another advantage of the assistants according to the invention is that they prevent the formation of reducing degradation products of wool. They therefore allow dyeing of textile combinations with synthetic fibres, for example wool/polyester or wool/polyacrylic, in which the synthetic fibre content is dyed with reduction-susceptible dyes.

The compounds employed for the process according to the invention are known in some cases, for example from DE-A 2 328 834. Some of the colourless fibre-reactive compounds are also novel compounds. The present invention furthermore relates to these novel compounds.

The novel colourless fibre-reactive compounds are those of the formula

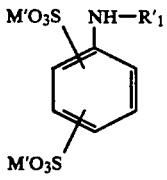

(1')

in which $R'_1$ is a radical of the formula

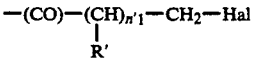

or a radical of the formula

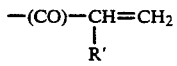

in which Hal is halogen, R' is hydrogen or halogen, M' is hydrogen or alkali metal and $n'_1$ is 1 or 0.

Other novel colourless fibre-reactive compounds are those of the formula

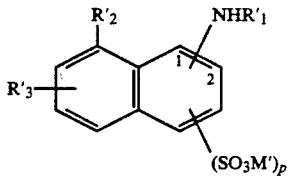

(2')

in which $R'_1$ is as defined in formula (1'), $R'_2$ is hydrogen, $SO_3M'$ or a radical of the formula O—X', in which X' is hydrogen or $C_1$ to $C_4$alkyl, p is 1 or 0 and $R'_3$ is hydrogen, $SO_3M'$ or a radical of the formula

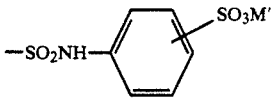

in which M' is as defined in formula (1'), in which, if X' is hydrogen, $R'_3$ is $SO_3M'$ and the $NHR_1$ radical in formula (2') is in the 2-position and p is 1, and if $R'_2$ is $SO_3M'$, $R'_3$, is hydrogen and p is 1.

The novel water-soluble fibre-reactive compounds according to the invention are prepared in a manner known per se.

Compounds of the formulae (1') and (2') are prepared, for example, by reacting a compound of the formula

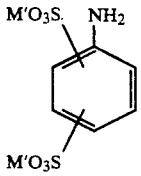

(3')

or of the formula

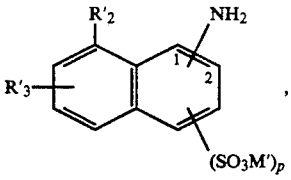

(4')

in which M' is hydrogen or alkali metal, $R'_2$ is hydrogen or a radical of the formula O—X', in which X' is hydrogen or $C_1$- to $C_4$alkyl, p is 0 or 1 and $R'_3$ is hydrogen, $SO_3M'$ or a radical of the formula

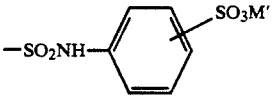

in which, if X' is hydrogen, $R'_3$ is $SO_3M'$, the $NH_2$ radical is in the 2-position and p is 1, and if $R'_2$ is $SO_3M'$, $R'_3$ is hydrogen and p is 1, with a compound of the formula

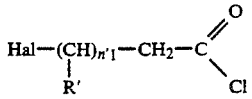

or of the formula

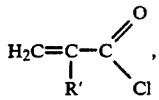

in which Hal is chlorine or bromine, R' is hydrogen, chlorine or bromine and $n'_1$ is 0 or 1.

The reaction time of this reaction is between 1 and 6, preferably 1 and 3 hours. A pH of 3 to 7, preferably 5 to 6, is maintained during the reaction. The reaction temperature here is between 0° and 20° C.

The known and novel colourless fibre-reactive compounds are used as intermediates for reactive dyes.

The examples which follow illustrate the invention. The parts and percentages are by weight. The temperatures are stated in °C.

PREPARATION OF THE NOVEL COMPOUNDS

EXAMPLE 1

31.9 parts of 2-amino-8-hydroxynaphthalene-3,6-disfulonic acid are suspended in 200 parts of water at 10° to 12° and dissolved by dropwise addition of 23 parts of a 15% sodium hydroxide solution at a pH of 7.31.3 parts of 2,3-dibromopropionyl chloride are added dropwise in the course of 1 hour, while stirring intensely and maintaining the same temperature. During this procedure, a pH of between 5.0 and 5.5 is maintained by simultaneous addition of 35 parts of a 15% sodium hydroxide solution. After stirring at 10° to 15° for a further 2 hours, the starting compound is no longer detectable by means of a diazotisation and coupling sample in the clear solution formed. The compound formed is precipitated out of the reaction solution by addition of 75 parts of potassium chloride, isolated by filtration and, after washing of the filter-cake with 30% potassium chloride solution, dried in vacuo at 50°. The yield is 55 parts of 2-(2',3'-dibromopropionyl)-amino-8-hydroxynaphthalene-3,6-disulfonic acid of the formula

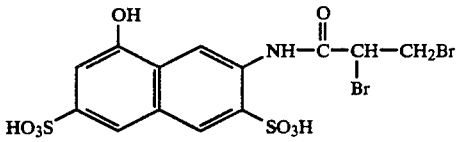

(101)

as the potassium salt in the form of a pale grey, readily water-soluble powder.

EXAMPLE 2

22.3 parts of 1-aminonaphthalene-4-sulfonic acid are dissolved in 400 parts of water at room temperature in the form of the sodium salt. 32 parts of 2,3-dibromopropionyl chloride are added dropwise in the course of 2 hours while stirring intensively. A pH of 6.0 to 6.5 is maintained at the same time by addition of 40 parts of a 15% sodium hydroxide solution. The novel compound precipitates completely in the course of the acylation reaction. After stirring for a further 4 hours, the starting compound is no longer detectable. The resulting suspension is filtered at room temperature and the filter-cake is washed with 400 parts of a 5% sodium chloride solution and then dried in vacuo at 50°. A pale yellowish, water-soluble powder is obtained. The yield reaches 44 g of 1-(2',3'-dibromopropionyl)aminonaphthalene-4-sulfonic acid of the formula

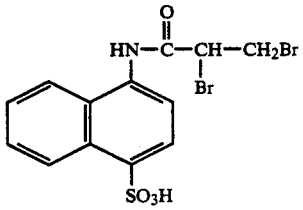

(102)

EXAMPLE 3

31.9 parts of 2-amino-8-hydroxynaphthalene-3,6-disulfonic acid are acylated with 2,3-dibromopropionyl chloride as described in Example 1. The resulting clear solution is cooled to 0° to 3° and brought to a pH of between 12.0 and 12.5 by addition of 28 parts of a 15% sodium hydroxide solution. After the mixture has been stirred at 0° to 5° for 3 hours, the splitting off of one equivalent of hydrogen bromide has ended. The resulting 2-(2'-bromoacryl)amino-8-hydroxynaphthalene-3,6-disulfonic acid of the formula

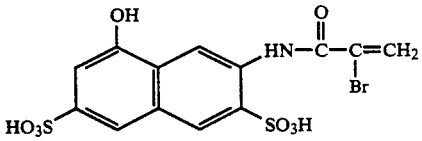

(103)

is isolated at the potassium salt after neutralisation of the reaction solution with 12 parts of a 15% strength hydrochloric acid according to Example 1.

The following Table 1 shows further acylating reagents with which the starting compounds (I) to (X) listed can be converted into colourless fibre-reactive compounds in accordance with the instructions of Example 1 to 3.

TABLE 1

| Acylating agent | Starting compound |
|---|---|
| 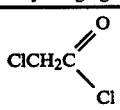 | I, IV, IX |
| 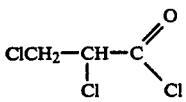 | I, II, III, V |
| 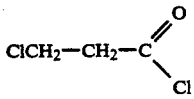 | I, II, IV, IX |
| 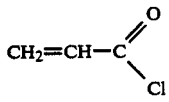 | I, III |

TABLE 1-continued

| Acylating agent | Starting compound |
|---|---|
| 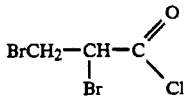 | III, IV, V, VI, VII, IX, X |

The starting compounds (I) to (X) have the following formulae:

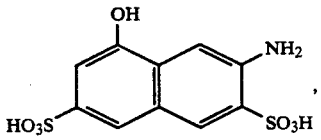

(I)

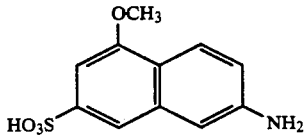

(II)

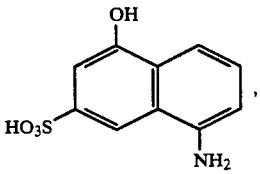

(III)

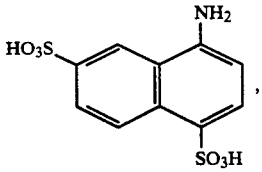

(IV)

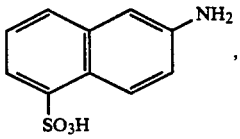

(V)

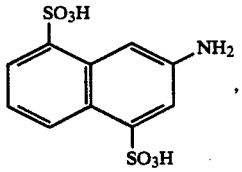

(VI)

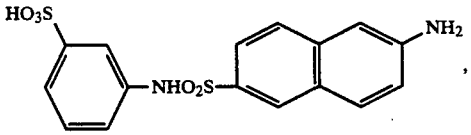

(VII)

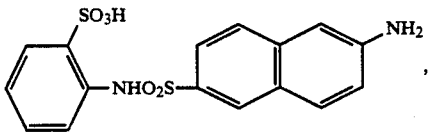

(VIII)

-continued

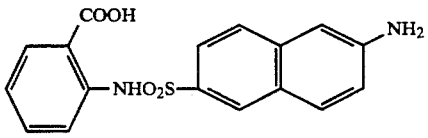

(IX)

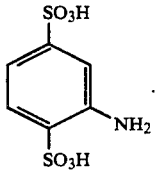

(X)

APPLICATION EXAMPLES

EXAMPLE 4

40 g of wool fabric are pretreated in a circulation apparatus by the beam dyeing method at 40° for 10 minutes. The liquor contains 4 g of sodium sulfate siccative, 0.8 g of sodium acetate, 2 g of 80% acetic acid, 800 ml of water, 0.4 g of a levelling agent consisting of a) 50 parts of the addition product, quaternised with chloroacetamide, of 7 mol of ethylene oxide on 1 mol of tallow fat amine and b) 50 parts of the ammonium salt of the acidic sulfuric acid monoester of the addition product of 7 mol of ethylene oxide on 1 mol of tallow fat amine, and 0.4 g of the colourless fibre-reactive compound of the formula

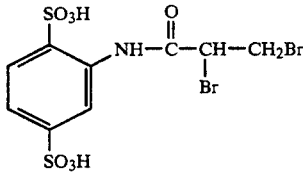

(104)

in the form of the sodium salt. The pH of the liquor is 4.5. After addition of a pale grey solution which contains 12 mg of the dye of the formula

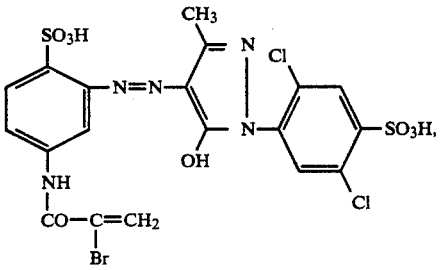

(105)

24 mg of the dye of the formula

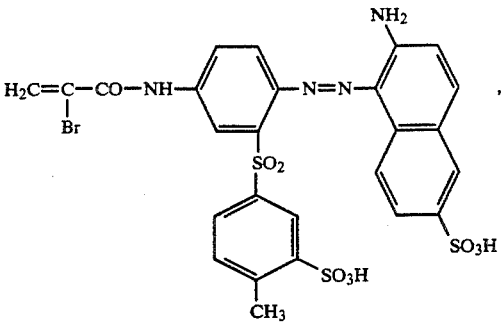

(106)

and 44 mg of the dye of the formula

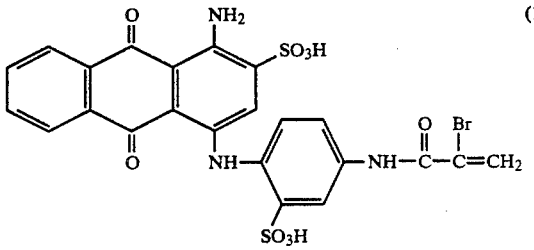

(107)

the dye liquor is kept at 40° for about a further 5 minutes and then heated to 60° with a heating-up rate of 1°/minute and kept at 60° for 20 minutes. It is then heated to 98° at 1°/minute and dyeing is carried out for 45 minutes. After the liquor has been cooled to 70°, the dyeing is finished in the customary manner. A fibre- and surface-level dyeing with good fastness properties is obtained. The surface levelness is considerably better than without the addition of the compound of the formula (104).

EXAMPLE 5

1 kg of worsted spun yarn in the form of a cheese is pretreated for 15 minutes in a circulation apparatus containing 100 g of sodium sulfate, 9 g of ammonium acetate, 37 ml of 80% acetic acid, 9 l of water, 9 g of a nonionic wetting agent based on 2-ethylhexanol and 10 g of a levelling agent corresponding to Example 4. The pH of the liquor is 4.7. After addition of a pale grey solution of 10 g of the colourless fibre-reactive compound of the formula

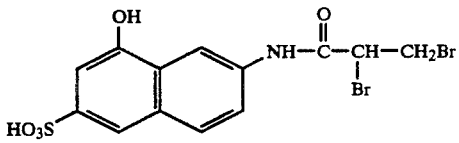

(108)

and 0.3 g of the dye of the formula (105), 0.6 g of the dye of the formula (106) and 1.1 g of the dye of the formula (107), dyeing is carried out as described in Example 1.

If required, an alkaline after-treatment, for example with ammonia, sodium carbonate or sodium bicarbonate, can follow in order to improve the fastness properties.

EXAMPLE 6

Instead of the compounds of the formulae (104) and (108) mentioned in Examples 4 and 5, the fibre-reactive colourless compounds of the formulae (109) to (120) are employed in amounts of 0.5 to 2%, based on the fibre weight.
(109)
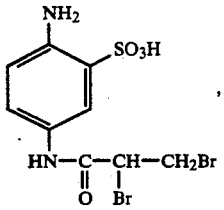
(110)
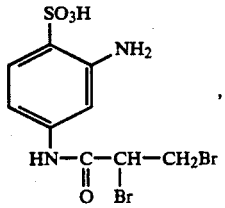
(111)
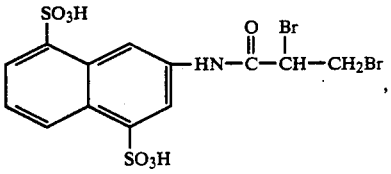
(112)
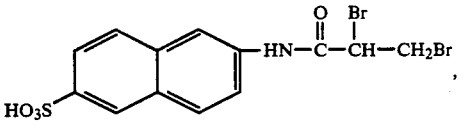
(113)
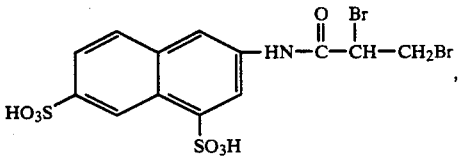
(114)
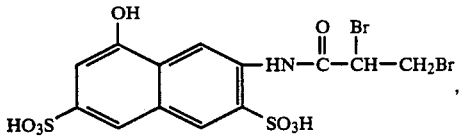
(115)
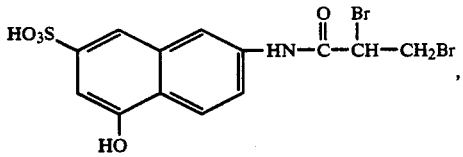
(116)
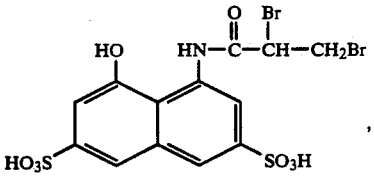
(117)
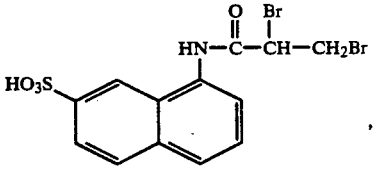

-continued (118)

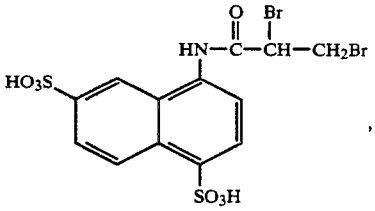

(119)

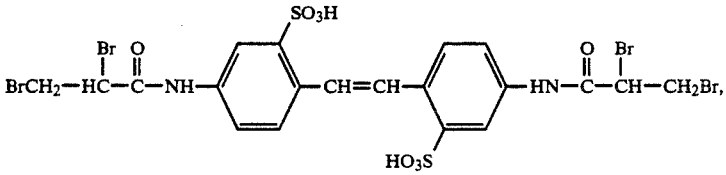

(120)

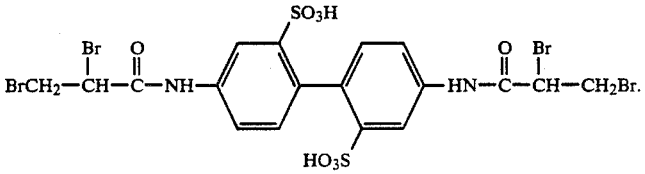

Similar results are obtained.

EXAMPLE 7

4 blank dye liquors which have a pH of 4.5, adjusted with acetic acid/acetate buffer, are prepared. 0.6 g of the colourless fibre-reactive compound of the formula (110) is added to liquor 1, 0.6 g g of the colourless fibre-reactive compound of the formula (112) is added to liquor 2 and 0.6 g of a wool protecting agent based on formaldehyde is added to liquor 3. Liquor 4 contains no further additions. 20 g of wool fabric are treated in each liquor at 120° for 30 minutes.

The damage to the fibres is tested with the aid of the "Baer Typ 201" ball penetration tester (Table 2):

TABLE 2

| Compound | % damage to the wool |
|---|---|
| Liquor 1 | 2.0 |
| Liquor 2 | 1.3 |
| Liquor 3 | 1.3 |
| Liquor 4 | 9.9 |

EXAMPLE 8

3 samples of 40 g each of an intimate fibre mixture which consists of 55 parts of polyester and 45 parts of wool are dyed in a beam dyeing apparatus. 3 dye liquors of 800 ml each which comprise, in addition to the samples, the following additions are prepared:

Liquor 1: A navy-blue dye mixture consisting of 22.4 mg of the dye of the formula (121)

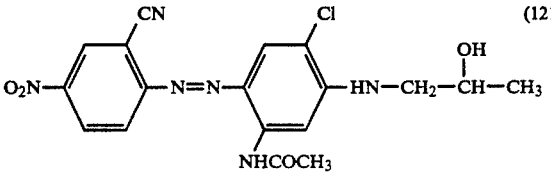

35.2 mg of the dye of the formula (122)

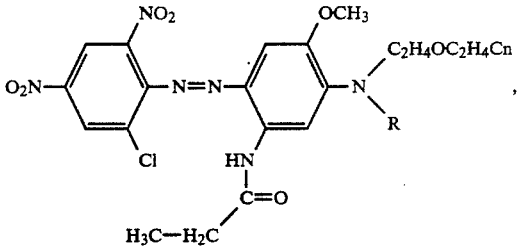

R = about 60% of H
about 40% of $C_2H_4OC_2H_4CN$ 9.2 mg of the dye of the formula (123)

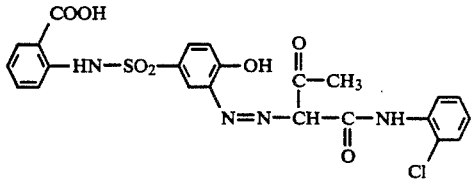

1:2 cobalt complex 6.8 mg of the dye of the formula

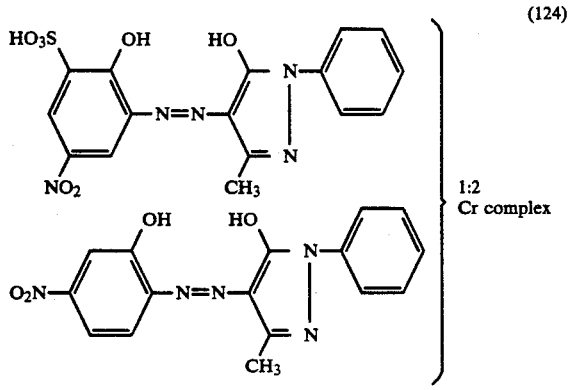

38.4 mg of the dye of the formula (125)

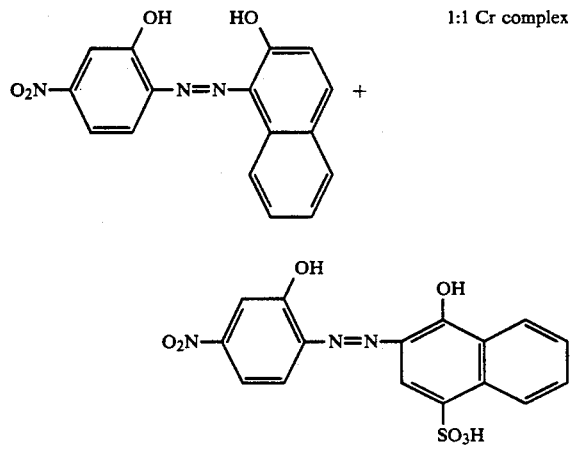

1.6 g of a wool protecting agent based on formaldehyde, 0.2 g of a levelling agent corresponding to Example 4 and 0.8 g of sodium acetate.

80% acetic acid is added to the individual liquors in an amount to achieve a pH of 5.0.

Liquor 2: Compared with liquor 1, this liquor additionally contains 1.2 g of the colourless fibre-reactive compound of the formula (104).

Liquor 3: Compared with liquor 1, this liquor additionally contains 1.2 g of the colourless fibre-reactive compound of the formula (112).

The temperature of the individual dye liquors is increased from 40° to 120° in the course of 40 minutes. Dyeing is then carried out at 120° for 40 minutes. After cooling to 70°, the dyeing is rinsed and finished in the customary manner.

The dyeing results are then compared. The dyeings of liquors 2 and 3 are distinctly more bluish-tinged, since the reduction-sensitive dye of the formula (122) bleaches to a lesser degree in the presence of the colourless fibre-reactive compounds. The difference becomes even more distinct if the wool content is dissolved out by treating with boiling 5% sodium hydroxide solution for 5 minutes. The polyester content is dyed considerably less intensely without the addition.

EXAMPLE 9

3 samples of 20 g each of a pure polyester fabric and 20 g of a wool fabric (liquors 1–3) are dyed simultaneously in a beam dyeing apparatus. Liquor 4 contains only 20 g of a polyester fabric (sample 4). The 4 dye liquors of 800 ml each contain the following additions:

Liquor 1: 0.1 g of the navy-blue dye of the formula (122), 0.1 g of the levelling agent corresponding to Example 4, 0.8 g of a wool protecting agent based on formaldehyde and 2 g/l of sodium acetate.

Liquor 2: Compared with liquor 1, this liquor additionally contains the colourless fibre-reactive compound of the formula (104).

Liquor 3: Compared with liquor 1, this liquor additionally contains the colourless fibre-reactive compound of the formula (112).

Liquor 4: This liquor contains the same additions as liquor 1 (reference liquor). 80% acetic acid is added to each of liquors 1 and 4 in an amount to achieve a pH of 5.5.

The temperature of the individual dye liquors is increased from 40° to 120° in the course of 40 minutes. Dyeing is then carried out at 120° for 40 minutes. After cooling to 70°, the dyeing is rinsed and finished in the customary manner.

The polyester dyeings are then evaluated colorimetrically. The values are shown in the following manner:

TABLE 3

| Treatment liquor | Colour strength of the polyester dyeing [%] |
|---|---|
| Liquor 1 | 35 |
| Liquor 2 | 65 |
| Liquor 3 | 77 |
| Liquor 4 (reference) | 100 |

The results show that the dyeings of liquors 2 and 3, which comprise the colourless fibre-reactive compounds, are distinctly stronger in colour than those without addition of these compounds (=liquor 1). Here also, these compounds prevent severe bleaching of the reduction-sensitive dye of the formula (122).

EXAMPLE 10

3 aqueous dye liquors of 400 ml each which comprise the following additions are prepared:

Liquor 1: A brown dye mixture consisting of 0.0048 g of the dye of the formula

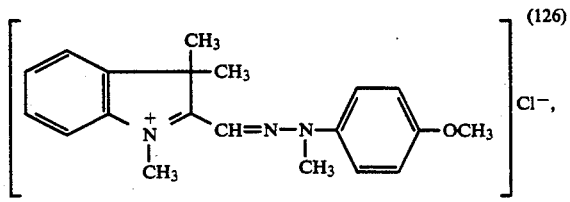

0.008 g of the dye of the formula

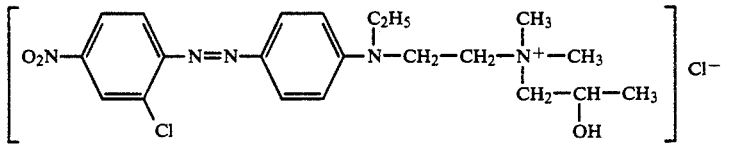

(127)

0.0825 g of the dye of the formula

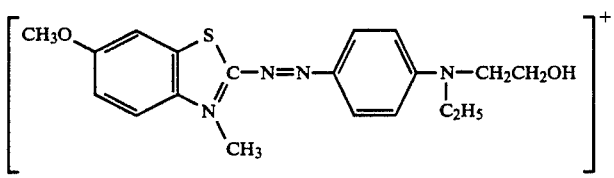

(128)

0.2 g of the colourless fibre-reactive compound of the formula (110), 0.2 g of the levelling agent corresponding to Example 4, 0.5 g of anhydrous sodium and 40 ml of citrate buffer of pH 5.0.

Liquor 2: As liquor 1, but without the addition of the compound of the formula (110).

Liquor 3: As liquor 1, but instead of the compound of the formula (110), the colourless fibre-reactive compound of the formula (104) is used.

5 g of an ®Orlon 42 staple fabric and 5 g of a prewetted piece of wool flannel are introduced into the individual dye liquors at 40°. The liquors are then heated up to 99° in the course of 40 minutes on a ®AHIBA dyeing apparatus, and dyeing is then continued at this temperature for a further 90 minutes. The liquors are then cooled and the dyeings are rinsed and finished in the customary manner.

The CIELAB colour differences between the three dyeings on Orlon 42 are then determined in accordance with DIN 6174 (D65/10) (Table 4):

TABLE 4

| | $dH^*_{ab}$ | $dE^*_{ab}$ |
|---|---|---|
| Dyeing of liquor 1 | 3.62 | 4.18 |
| Dyeing of liquor 2 | 5.45 | 6.14 |
| Dyeing of liquor 3 | 3.01 | 3.48 |

dH*: Content of the colour shade in the total colour difference
dE*: Total colour difference The grey dyeings of liquors 1 and 3 are distinctly more bluish-tinged than those of liquor 2, since the colourless compounds of the formulae (104) and (110) improve the stability of the dye of the formula (128) toward reducing hydrolysis products of wool.

A grey dyeing produced on pure polyacrylic as follows serves as the reference: 5 g of an ®Orlon 42 staple fabric are added to the dyebath, which is heated to 70°, comprising the same dye additions as liquors 1, 2 and 3 and also 0.05 g of a cationic retarder based on a quaternised alkylammonium salt, 0.25 g of anhydrous sodium sulfate, 0.15 g of 40% acetic acid and 0.05 g of sodium acetate. The liquor ratio is 1:40 (200 ml) and the pH is 4.5. The dyebath is then heated to 99° in the course of 30 minutes. and dyeing is subsequently continued at this temperature for a further 90 minutes. The dyebath is then cooled and the dyeing is finished in the customary manner.

What is claimed is:

1. A process for non-skittery and level dyeing of wool or a blend thereof with other fibres using reactive dyes, which comprises using an aqueous liquor which comprises at least one colourless, fibre-reactive compound of the formula $$A\text{-}(B\text{-}A)_n, \quad (1)$$

in which n is 0 or 1, and if n is 1, A is a radical of the formula

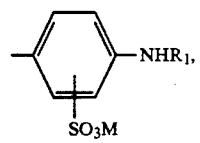

(2)

and B is an alkylene or alkenylene group or a direct bond, or if n is zero, A is a compound of the formula

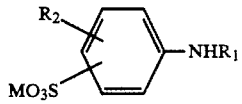

(3)

or of the formula

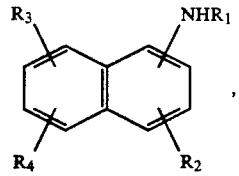

(4)

in which, in the formulae (1) to (4), $R_1$ is a radical of the formula

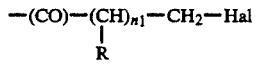

or of the formula

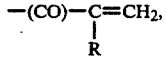

in which Hal is halogen, R is hydrogen or halogen, $n_1$ is 1 or 0, $R_2$ is hydrogen, $SO_3M$ or $—NH_2$, $R_3$ is hydrogen, $SO_3M$ or a radical of the formula —OX, in which X is hydrogen or $C_1$ to $C_4$alkyl, $R_4$ is hydrogen, $SO_3M$ or a radical of the formula

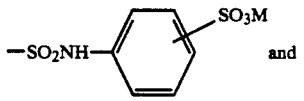

(5)

M is hydrogen, an alkali metal or ammonium, and the compound of the formula (4) contains at least one —$SO_3M$ group, for dyeing these materials and finishing the dyeing at a pH of 4.0 to 5.0, regardless of the depth of shade.

2. The process of claim 1, wherein a compound of the formula

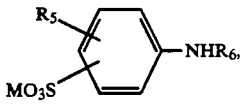

(6)

in which $R_5$ is hydrogen or $SO_3M$, $R_6$ is a radical of the formula

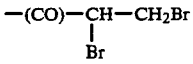

or of the formula

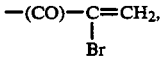

and M is as defined in formula (3), is used as the colourless fibre-reactive compound.

3. The process according to claim 1, wherein a compound of the formula

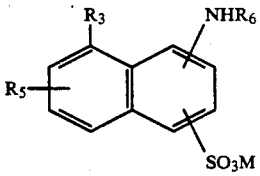

(7)

in which $R_3$, $R_5$, $R_6$ and M are defined in formulae (4) and (6) is used as the colourless fibre-reactive compound.

4. The process of claim 1, wherein the fibre material is dyed in pale to medium dark shades.

5. The process of claim 1, wherein the colourless fibre-reactive compounds are added to the dyebath in amounts of between 0.3 and 3% by weight, based on the fibre material to be dyed.

6. The process of claim 1, wherein reactive dyes which contain at least one sulfo group are used as the dyes.

7. The process of claim 1, wherein reactive dyes which contain chloroacryloyl, dichloropropionyl, chloroacetyl, bromoacryloyl or dibromopropionyl as reactive substituents are used.

8. The process of claim 1, wherein the dyeing is carried out at a temperature between 60° and 120° C.

9. The process of claim 1, wherein the dyeing is carried out at a liquor ratio of 1:3 to 1:100.

10. A dyeing assistant which comprises at least one colourless fibre-reactive compound of the formula

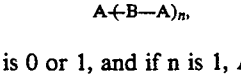

(1)

in which n is 0 or 1, and if n is 1, A is a radical of the formula

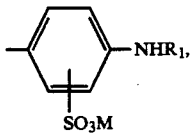

(2)

and B is an alkylene or alkenylene group or a direct bond, or if n is zero, A is a compound of the formula

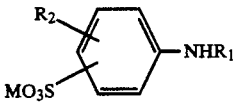

(3)

or of the formula

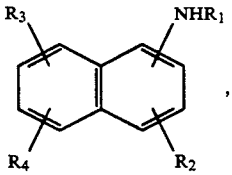

(4)

in which, in the formulae (1) to (4), $R_1$ is a radical of the formula

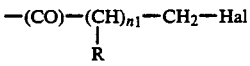

or of the formula

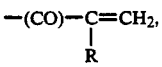

in which Hal is halogen, R is hydrogen or halogen, $n_1$ is 1 or 0, $R_2$ is hydrogen, $SO_3M$ or —$NH_2$, $R_3$ is hydrogen, $SO_3M$ or a radical of the formula —OX, in which X is hydrogen or $C_1$ to $C_4$alkyl, $R_4$ is hydrogen, $SO_3M$ or a radical of the formula

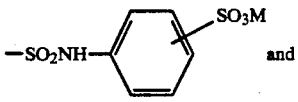

(5)

M is hydrogen, an alkali metal or ammonium, and the compound of the formula (4) contains at least one —$SO_3M$ group, and a carrier.

11. A dyeing assistant according to claim 10, which comprises at least one compound of the formula

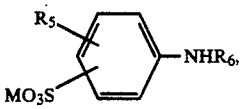

(6)

in which $R_5$ is hydrogen or $SO_3M$, $R_6$ is a radical of the formula

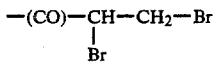
or of the formula
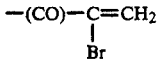
and M is as defined in formula (3).
12. A dyeing assistant according to claim 10, which comprises at least one compound of the formula
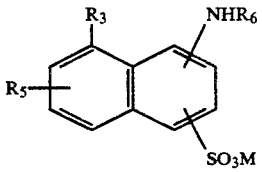
(7)
in which $R_3$, $R_5$, $R_6$ an M are as defined in formulae (4) and (6).
13. The fibre material dyed according to claim 1.
14. The process of claim 9, wherein the dyeing is carried out at a liquor ratio of 1:8 to 1:30.
* * * * *